US009901206B2

(12) United States Patent
Coleman

(10) Patent No.: US 9,901,206 B2
(45) Date of Patent: Feb. 27, 2018

(54) BOUNCING ORNAMENT

(71) Applicant: Shawn Coleman, Huntington, NY (US)

(72) Inventor: Shawn Coleman, Huntington, NY (US)

( * ) Notice: Subject to any disclaimer, the term of this patent is extended or adjusted under 35 U.S.C. 154(b) by 0 days.

(21) Appl. No.: 14/248,222

(22) Filed: Apr. 8, 2014

(65) Prior Publication Data

US 2016/0053939 A1 Feb. 25, 2016

(51) Int. Cl.
*E04G 3/00* (2006.01)
*A47G 33/08* (2006.01)

(52) U.S. Cl.
CPC ..... *A47G 33/0809* (2013.01)

(58) Field of Classification Search
CPC ..... A47G 33/0809; H02K 21/125; H02K 2201/12
See application file for complete search history.

(56) References Cited

U.S. PATENT DOCUMENTS 2,059,653 A * 11/1936 Pretzfelder ..... A47G 33/08 362/121
4,985,883 A * 1/1991 Hou ..... G11B 33/06 369/69
5,568,970 A * 10/1996 Prineppi ..... A47G 33/0809 254/390
5,954,418 A * 9/1999 Prineppi ..... A47G 33/0809 310/257
8,758,077 B2 * 6/2014 Jang ..... A63H 13/06 446/334

* cited by examiner

*Primary Examiner* — Amy J. Sterling
(74) *Attorney, Agent, or Firm* — Dunlap Bennett & Ludwig PLLC

(57) ABSTRACT

A bouncing ornament that includes housings a motor, a transmission mechanism and a transmission conduit The transmission mechanism transfers the motion of the motor to the ornament via a spring which causes the ornament to bounce up and down.

8 Claims, 11 Drawing Sheets

BOUNCING ORNAMENT

RELATED APPLICATION

This application claims priority to U.S. Provisional Patent Application No. 61/853,623, Filing Date Apr. 9, 2013, Entitled Luminescent Ornament.

BACKGROUND

An ornament that connects by a tether, spring, and bungee to a housing that rests, hangs, mounts, and sits at its desired display location. The housing holds a motor that provides the up and down motion to the tether, spring, and bungee causing the ornament to bounce up and down. This adds a unique motion to the ornament that current ornament designs don't have.

SUMMARY OF THE INVENTION

According to one preferred embodiment of the current invention, a bouncing ornament may comprise: at least one ornament but can be up ten ornaments that connects to an upper housing by a tether, spring and bungee. The upper housing can connect to a remote motor housing by a transmission conduit. By using a remote motor housing the weigh, size and bulk of the motor and other mechanisms are moved from the upper housing to the remote motor housing. In one preferred embodiment the desired location can be the tip of a Christmas tree branch which could bend due to the weight of the components. By using a remote motor housing the weight, size and bulk of the components can be moved further along the branch towards the trunk of the tree. In a second preferred embodiment of the current invention: the ornament itself can connect directly to the remote motor housing to eliminate the upper housing.

The Bouncing Ornament FIG. 1 through FIG. 9 may be made with any material. The configuration needs to be such that the ornament hangs freely so it can bounce up and down when powered on. It can do this by taking advantage of the ornaments "natural frequency". This can be explained by Hook's Law which will determine the period (the number of bounces per second) of the ornament on the tether, spring and bungee, from this point forward also know as the spring. Spring stiffness can be used to control the level of dampening by increasing the thickness or decreasing thickness of the spring. By adding a "Periodic Driving Force" (a motor or a solenoid) configured to generate a periodic push or pull depending on the application also know as the pulse of force (a device that gives a small push periodically like someone pushing a swing). This will cause the ornament to develop and maintain a periodic motion also known as a "Simple Harmonic Motion".

In order to keep the ornament moving requires the addition of more energy or force. This can be accomplished by pulling up and pushing down (releasing to gravity) the spring with the ornament attached. Please note the length of the throw can be very small at least 1 mm and up to approximately 50 mm but preferably between 10 mm and 25 mm and can vary according to the need of the design and to accommodate the weight of the ornament. A very small push can add energy efficiently if it happens at the instant when the ornament has moved to its highest position and begins to move back to the point of stable equilibrium. If the push occurs a little late then not all of the energy of the push is added (inefficient use of energy). Still worse is if the push occurs too soon, when this happens the result will be to counter act some or all of the momentum, slowing it down or stopping it altogether. The goal is to add a small amount of energy to the cycle to compensate for the energy lost due to friction. By adding energy correctly it will keep the ornament bouncing smoothly and at a uniform rate with very little input of power. This is know as resonance which occurs when the rhythm of the energy source matches the natural characteristic frequency of the oscillation, otherwise called the resonant frequency. Please note it is common to call the source of energy the driving force.

Another issue is that the ornament can sometimes vary in weight due to the amount of moisture in the environment or other factors. Also the tension of the spring can change due to environmental temperature. This means that due to Hook's Law that the Natural Frequency will change. In order to maintain the bouncing uniformity the period of energy input will need to vary by adjusting the motor's speed. This can be accomplished by the use of a movement adjustment. A second way to maintain the bouncing uniformity is to adjust the ornament's weight by adding or subtracting supplementary weight. Energy input does not need to happen on every cycle and can happen on alternate cycles, such as but not limited to every 2nd, 3rd, 4th, 5th, 6th, 7th, 8th, 9th, 10th cycle and so on so that the driving force is applied at a rate equal to the loss due to friction. (Like pushing a swing sometimes you can skip a push and the swing still maintains its motion smoothly)

DETAILED DESCRIPTION

Figure 1:
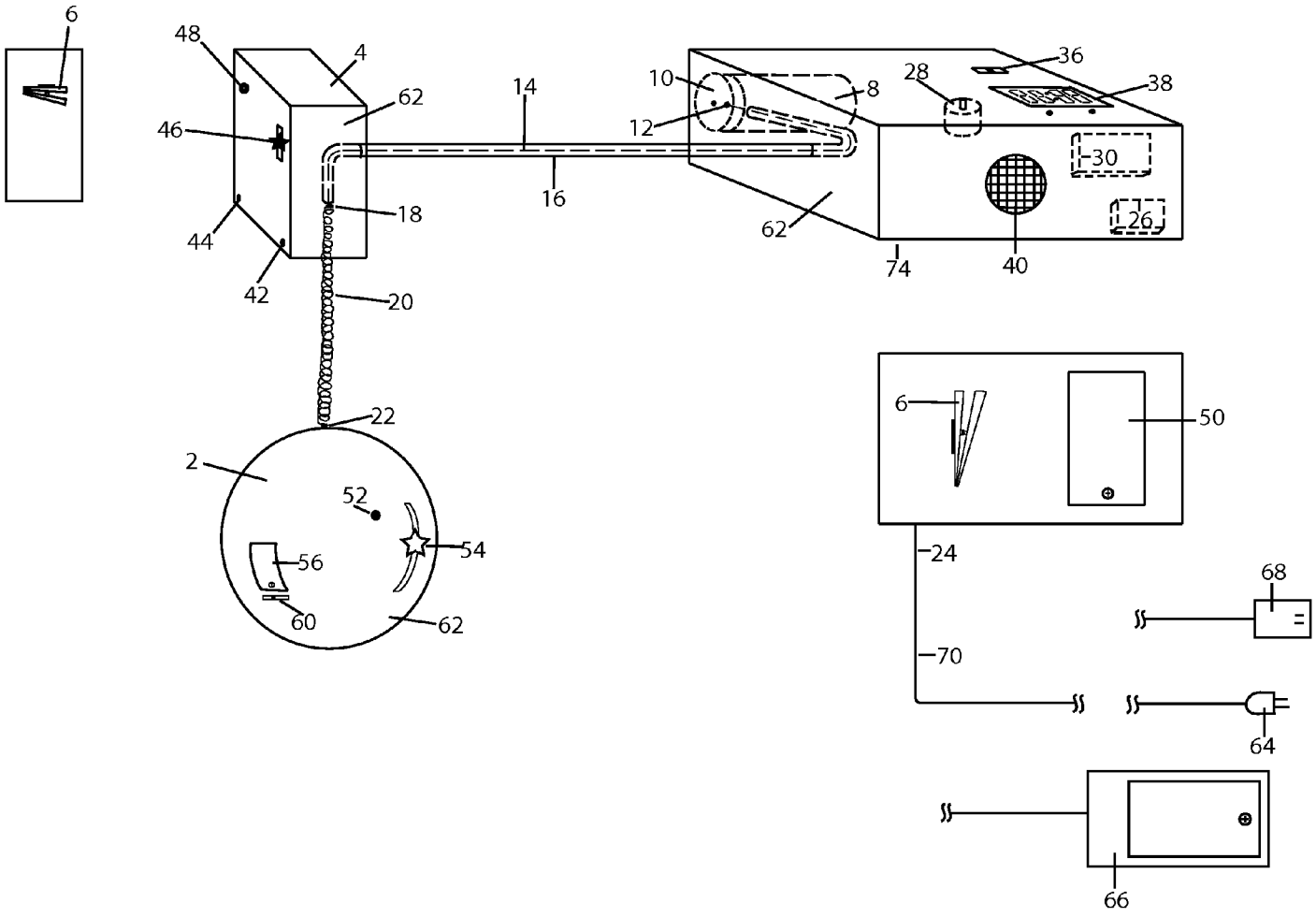
FIG. 1 Shows a remote motor driven perspective view
FIG. 2 Shows a remote solenoid driven perspective view
FIG. 3 Shows a remote muscle wire driven perspective view
FIG. 4 Shows a motor driven perspective view
FIG. 5 Shows a solenoid driven perspective view
FIG. 6 Shows a muscle wire driven perspective view
FIG. 7 Shows a wreath
FIG. 8 Shows the transmission swivel and length adjustment mechanisms
FIG. 9 Shows a spring power extension
FIG. 10 Shows a fireplace embodiment
FIG. 11 Shows an alternate transmission length adjustment mechanism

Referring to FIGS. 1 through 8, the present invention includes a bouncing ornament. The bouncing ornament includes a rotor 10 having a front surface and an outer edge forming the circumference of the rotor 10. A motor 8 rotates the rotor 10. The present invention further includes an upper housing 4. A transmission mechanism 14, such as a tether, runs through the upper housing 4. The tether includes a first end and a second end. A swivel 12 connects the first end of the tether to the front surface of the rotor 10. The swivel 12 is connected to the rotor off center of the front surface in between a longitudinal axis of the rotor 10 and the outer edge of the rotor 10. An ornament 2 is attached to the second end of the tether and is disposed below the upper housing 4. A same directional circular motion of the rotor 10 pulls the ornament 2 upward and releases the ornament 2 downward.

Referring to FIG. 1, a remote motor driven bouncing ornament includes; an ornament 2, an ornament upper housing 4, in this embodiment it can be for a decorative purpose and also to hold any other miscellaneous lights 48, photovoltaic sensor 44, motion sensor 42, motion device 46.

The ornament 2, is attached to the spring 20, with the ornament to spring connector 22. The spring 20, at the top connects to the a transmission mechanism 14, in this case a line made of thread, by means of a spring to transmission connector 18, that connector in this embodiment is a clip attached to the transmission mechanism 14. The transmission mechanism 14, is supported and rides in the transmission conduit 16, that terminates in the upper housing 4. The transmission conduit 16, on the remote motor housing 74, side terminates in front of the rotor 10, where the transmission mechanism 14 connects to the transmission attachment swivel mechanism 12, this is to allow the rotation of the motor to be converted into a pulling force and the swivel keeps the motion smooth and prevents the binding of the transmission mechanism 14. This can also be configured like a "train wheel to the piston" type of gear to track mechanism which results in the same circular motion being converted to linear motion. The upper housing 4, can connect to its display location by an attachment mechanism 6, this holds the upper housing 4, in place with the ornament suspended below connected by the spring 20. The remote motor housing 74, can also house an internal transformer 26, that powers the motor 8. The motor 8, speed can be controlled by a movement adjustment 28. The motor 8, receives power by the power supply wire 24, and the internal battery compartment 50. The remote motor housing 74, can also contain other devices such as but not limited to a motion sensor 42, a photovoltaic sensor 44, a motion device (additional) 46, a light or lights 48, an internal sound device 40, and an internal sequencer 30, to control the lights music and motion. The remote motor housing 74, can have an internal clock/timer 38, to turn the ornament on at certain times and for a certain amount of time. The remote motor housing can also have an internal switch 36, to turn the device on and off. The remote motor housing 74, can attach to its mounting point by use of an attachment mechanism 6. The remote motor housing 74, and the upper housing 4 can receive power by an external transformer 68, wire 70, that terminates in a plug 64, and an external battery compartment 66. The ornament 2, can have a light or lights on the ornament 52, an ornament motion device (additional) 54, an ornament battery compartment 56, an ornament switch 60. All of the housings 4, 74, and the ornament 2, can have surface coatings 62, This embodiment is meant to be displayed on but not limited to a Christmas tree, wreath, a mantle, a window, from a ceiling, from a computer, a car mirror, or any other display location that is desired.

Figure 2:
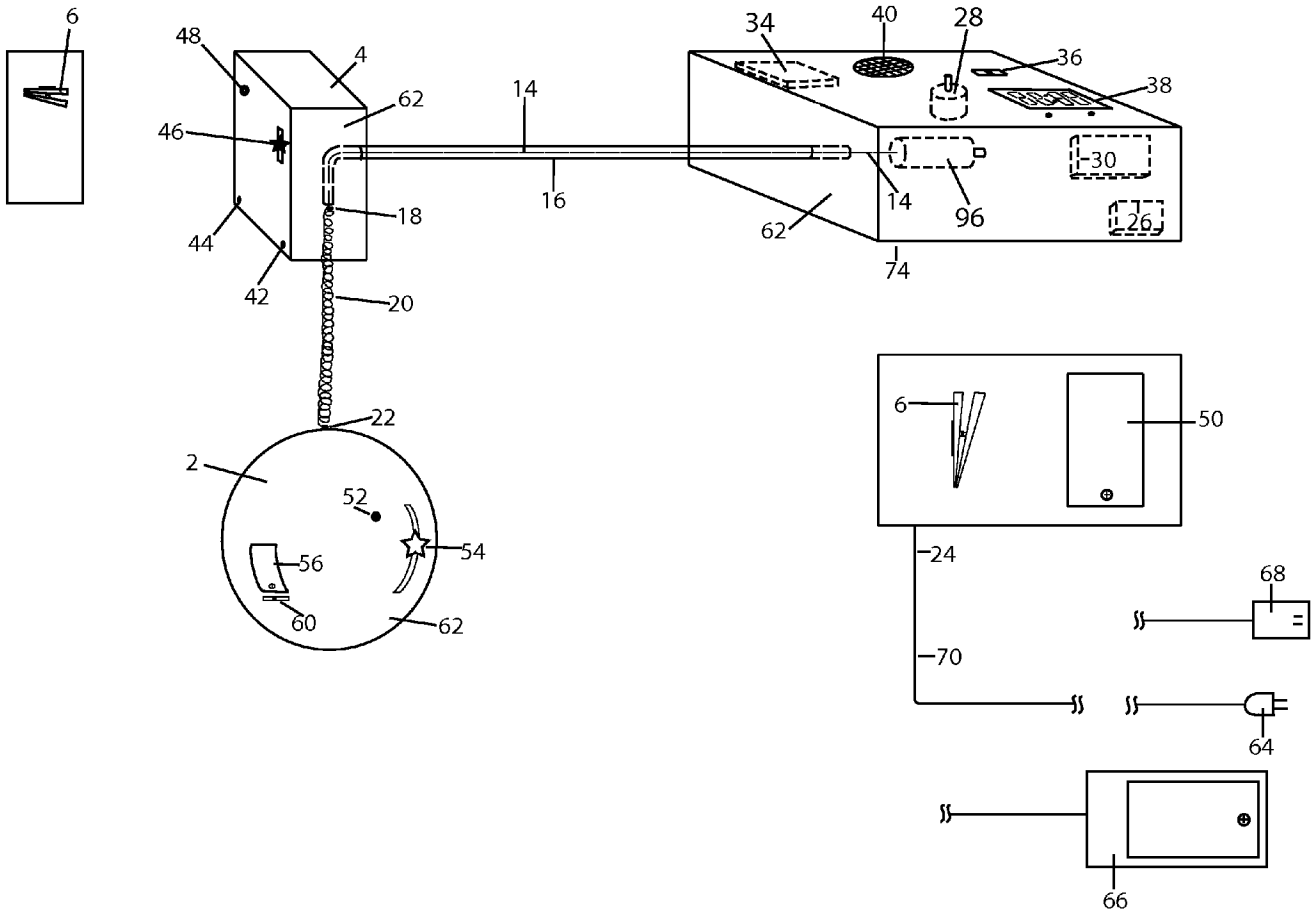

Referring to FIG. 2, a remote solenoid driven bouncing ornament comprising; This embodiment is the same as the first embodiment except in the following instances. The motion device is a solenoid 96, that connects to the transmission mechanism 14. The solenoid 96, is controlled by an internal timer circuit 34, which determines the electricity pulse rate that powers the solenoid 96. Please see the "FIG. 1" description for the detailed description of the remaining components.

Figure 3:
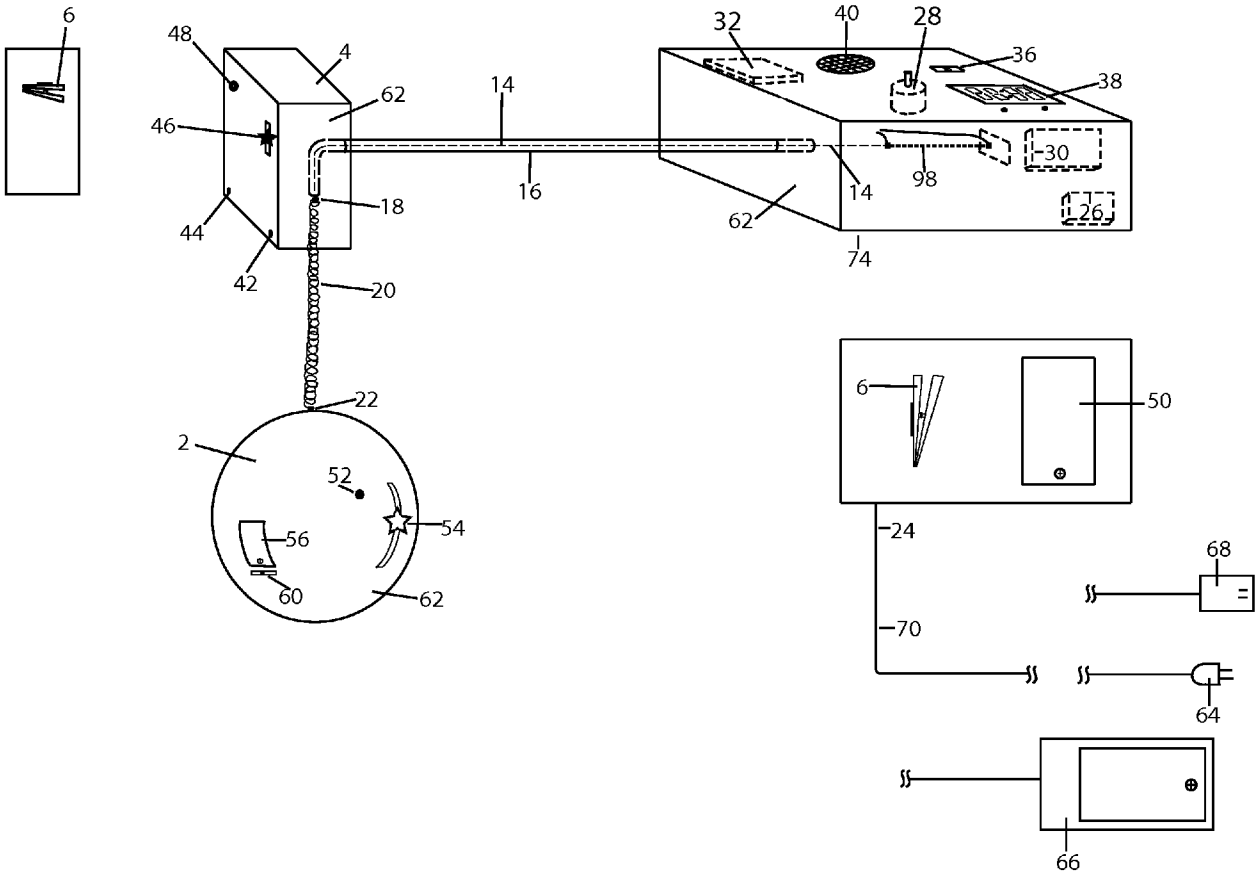

Referring to FIG. 3, a remote muscle wire driven bouncing ornament comprising; This embodiment is the same as the first embodiment except in the following instances. The motion device is a muscle wire 98, that connects directly to the transmission mechanism 14. The motion is controlled by a muscle wire controller circuit 32, which determines the electricity pulse rate that powers the muscle wire 98. Please see the "FIG. 1" description for the detailed description of the remaining components.

Figure 4:
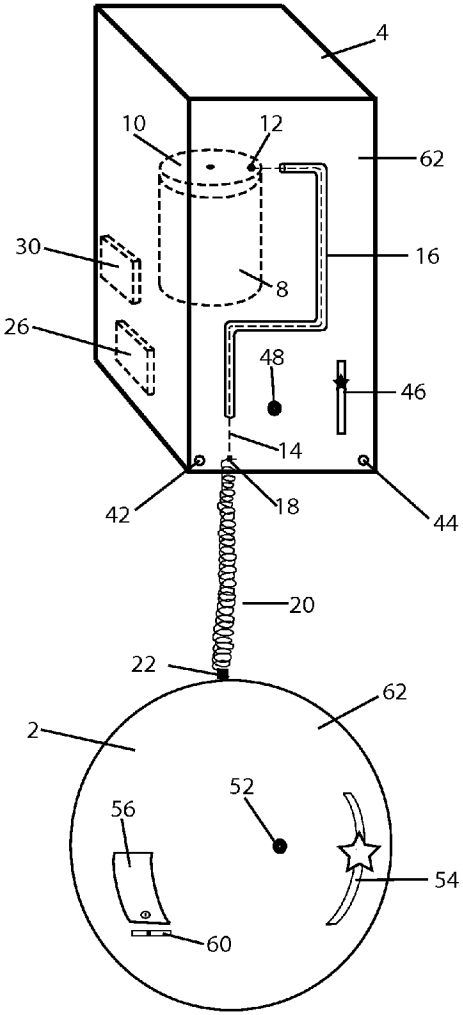
Figure 4:
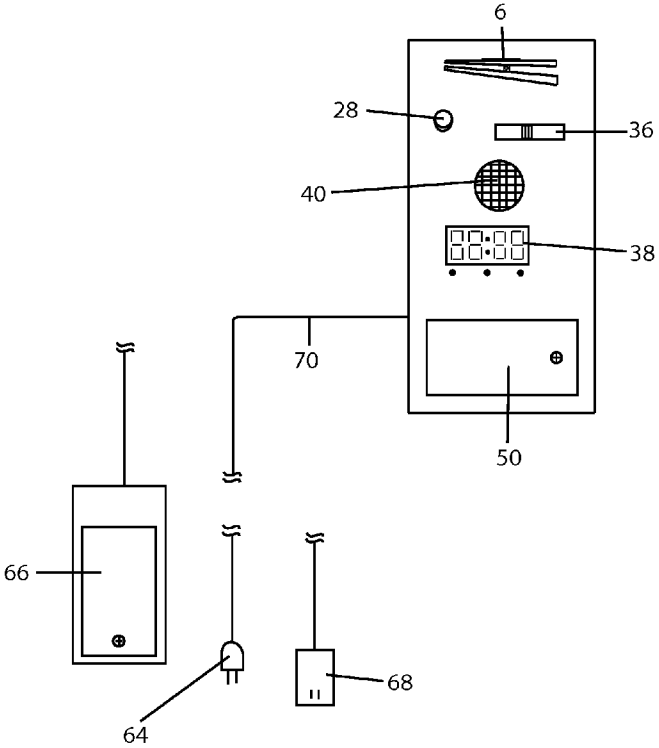

Referring to FIG. 4 a motor driven bouncing ornament comprising; an ornament 2, which is attached to the spring 20, with the ornament to spring connector 22. The spring 20, at the top connects to the a transmission mechanism 14, in this case a line made of thread, by means of a spring to transmission connector 18, that connector in this embodiment is a clip attached to the transmission mechanism 14. The transmission mechanism 14, is supported and rides in the transmission conduit 16, which terminates in front of the rotor 10, where the transmission mechanism 14 connects to the transmission attachment swivel mechanism 12, this is to allow the rotation of the motor the be converted into a pulling force and the swivel keeps the motion smooth and prevents the binding of the transmission mechanism 14. The upper housing 4, can connect to its display location by an attachment mechanism 6, this holds the upper housing 4, in place with the ornament suspended below connected by the spring 20. The upper housing 4, can also house an internal transformer 26, that powers the motor 8. The motor 8, speed can be controlled by a movement adjustment 28. The motor 8, receives power by the power supply wire 24, and the internal battery compartment 50. The upper housing 4, can also contain other devices such as but not limited to a motion sensor 42, a photovoltaic sensor 44, a motion device (additional) 46, a light or lights 48, an internal sound device 40, and an internal sequencer 30, to control the lights music and motion. The upper housing 4, can have an internal clock/timer 38, to turn the ornament on at certain times and for a certain amount of time. The upper housing 4, can also have an internal switch 36, to turn the device on and off. The upper housing 4 can receive power by an external transformer 68, wire 70, that terminates in a plug 64, and an external battery compartment 66. The ornament 2, can have a light or lights on the ornament 52, an ornament motion device (additional) 54, an ornament battery compartment 56, an ornament switch 60. The housing 4, and the ornament 2, can have surface coatings 62, This embodiment is meant to be displayed on but not limited to a Christmas tree, wreath, a mantle, a window, from a ceiling, from a computer, a car mirror, or any other display location that is desired.

Figure 5:
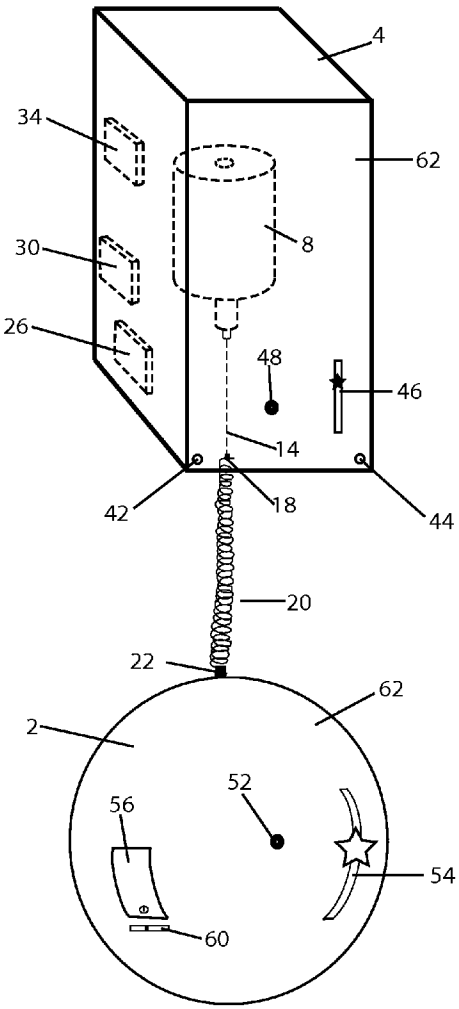
Figure 5:
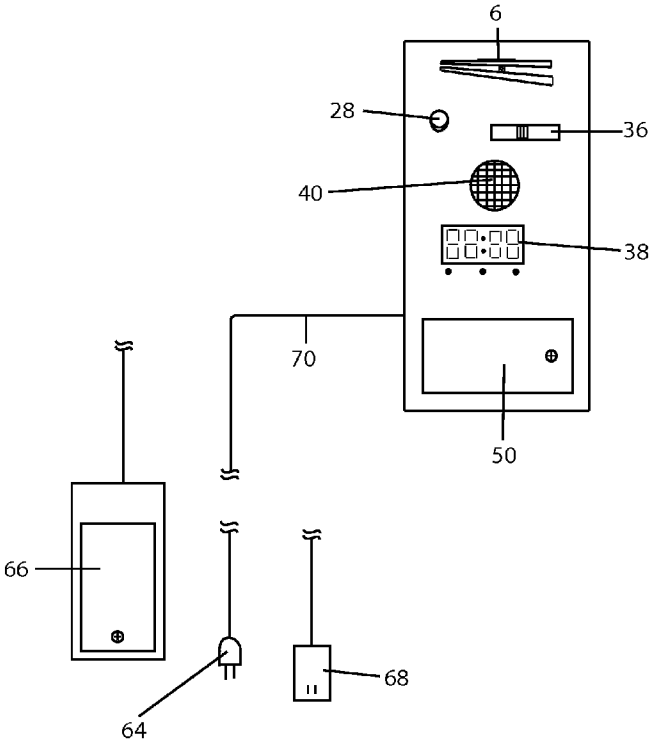

Referring to FIG. 5, a solenoid driven bouncing ornament comprising; This embodiment is the same as the first embodiment except in the following instances. The motion device is a solenoid 96, that connects to the transmission mechanism 14. The solenoid 96, is controlled by an internal timer circuit 34, which determines the electricity pulse rate that powers the solenoid 96. Please see the "FIG. 4" description for the detailed description of the remaining components.

Figure 6:
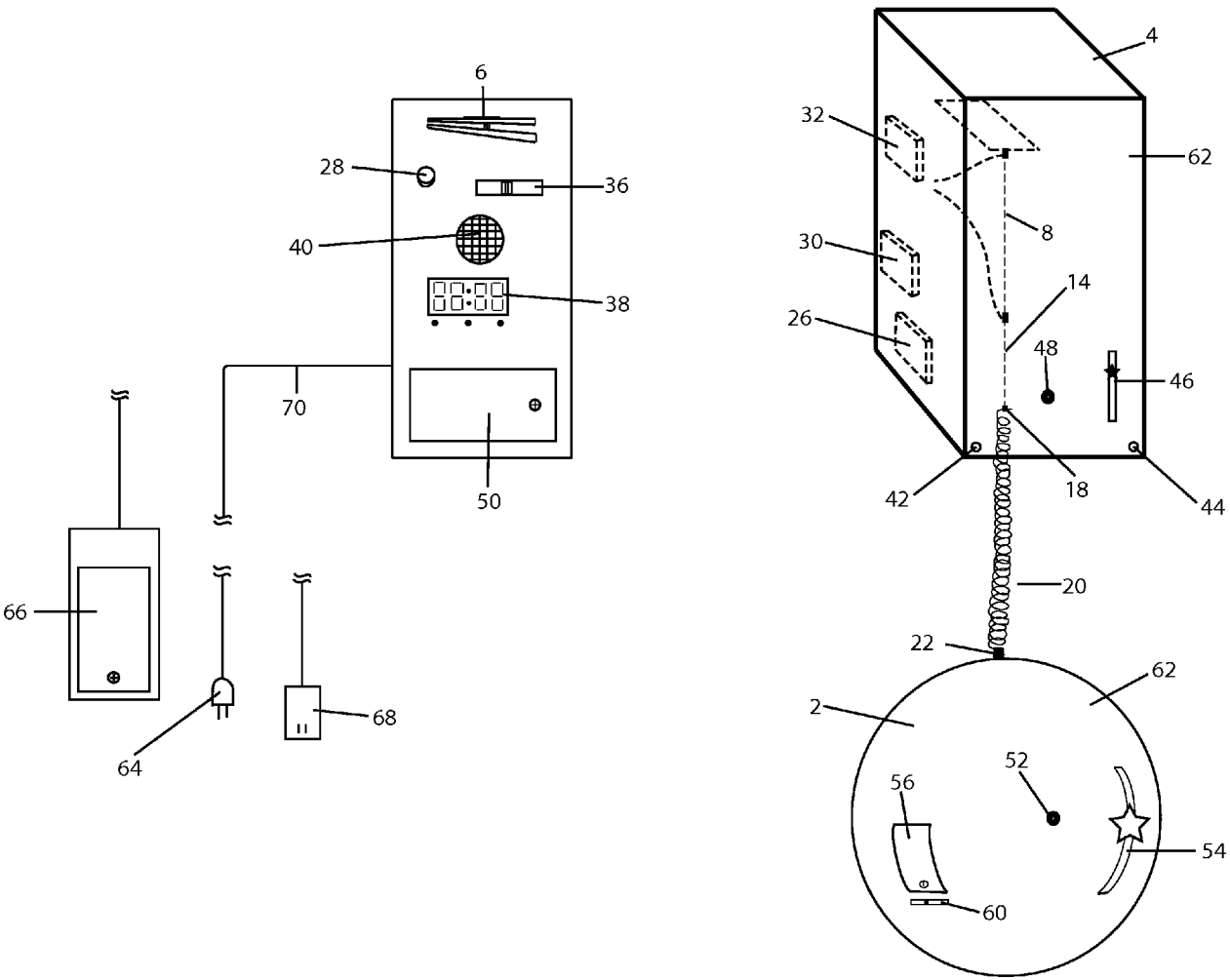

Referring to FIG. 6, a muscle wire driven bouncing ornament comprising; This embodiment is the same as the first embodiment except in the following instances. The motion device is a muscle wire 98, that connects directly to the transmission mechanism 14. The motion is controlled by a muscle wire controller circuit 32, which determines the electricity pulse rate that powers the muscle wire 98. Please see the "FIG. 4" description for the detailed description of the remaining components.

Figure 7:
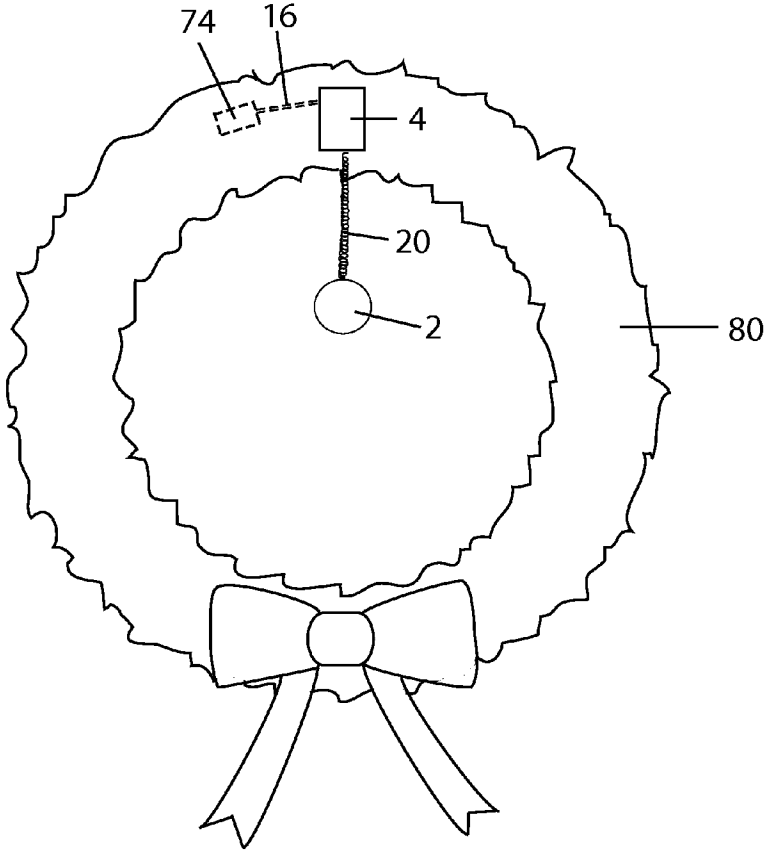

Referring to FIG. 7, a wreath mounted bouncing ornament comprising; ornament 2, an ornament upper housing 4, a transmission conduit 16, a spring 20, a remote motor housing 74, a wreath 80. In this embodiment the upper motor housing 74, can be attached to the wreath either hidden in the branches or behind the branches. In some designs the upper housing can be designed so that it would be desirable to attach the remote motor housing on the surface of the wreath.

Figure 10:
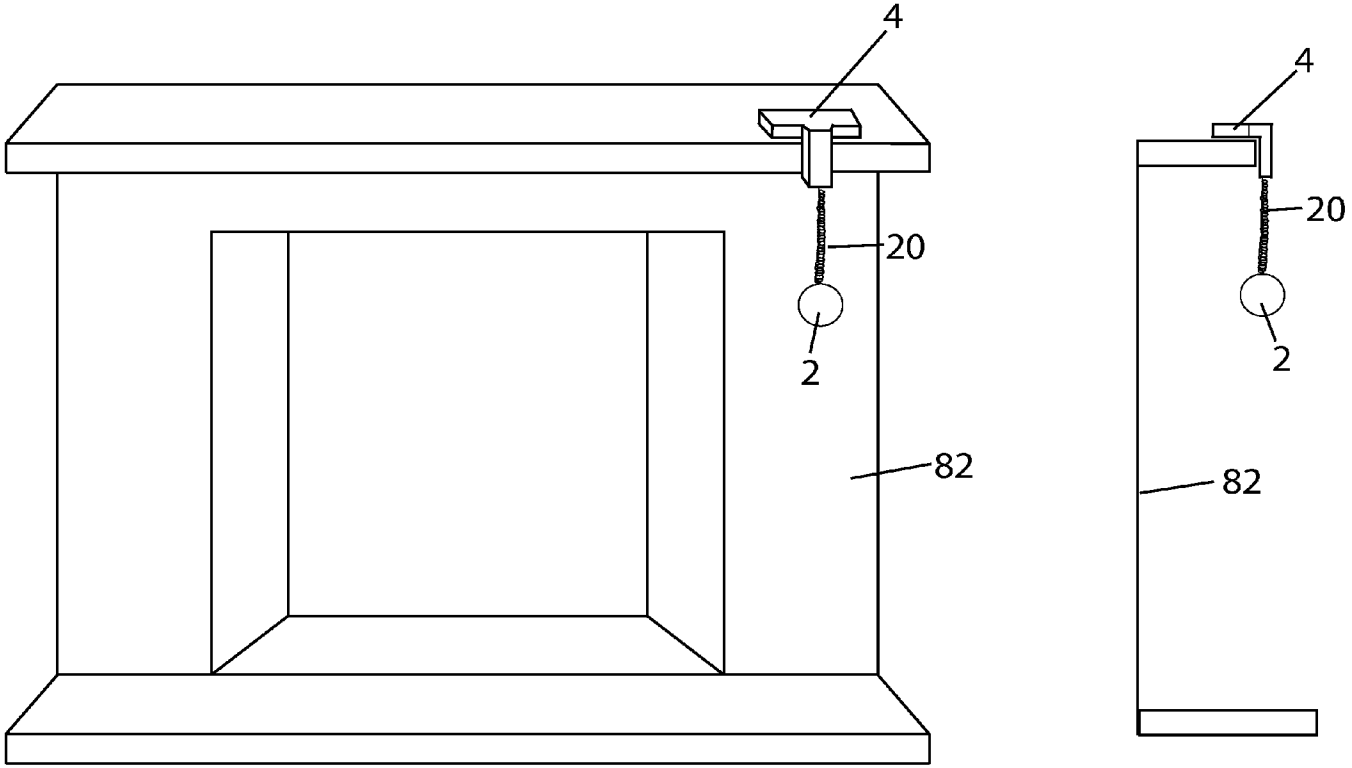

Referring to FIG. 10, a fireplace mounted bouncing ornament comprising; ornament 2, an ornament upper housing 4, a spring 20, a fireplace 82. In this embodiment the upper housing can be constructed so that it is heavy enough that it remains in place due to its weight. This embodiment can also be used for any flat surface edge.

Figure 8:
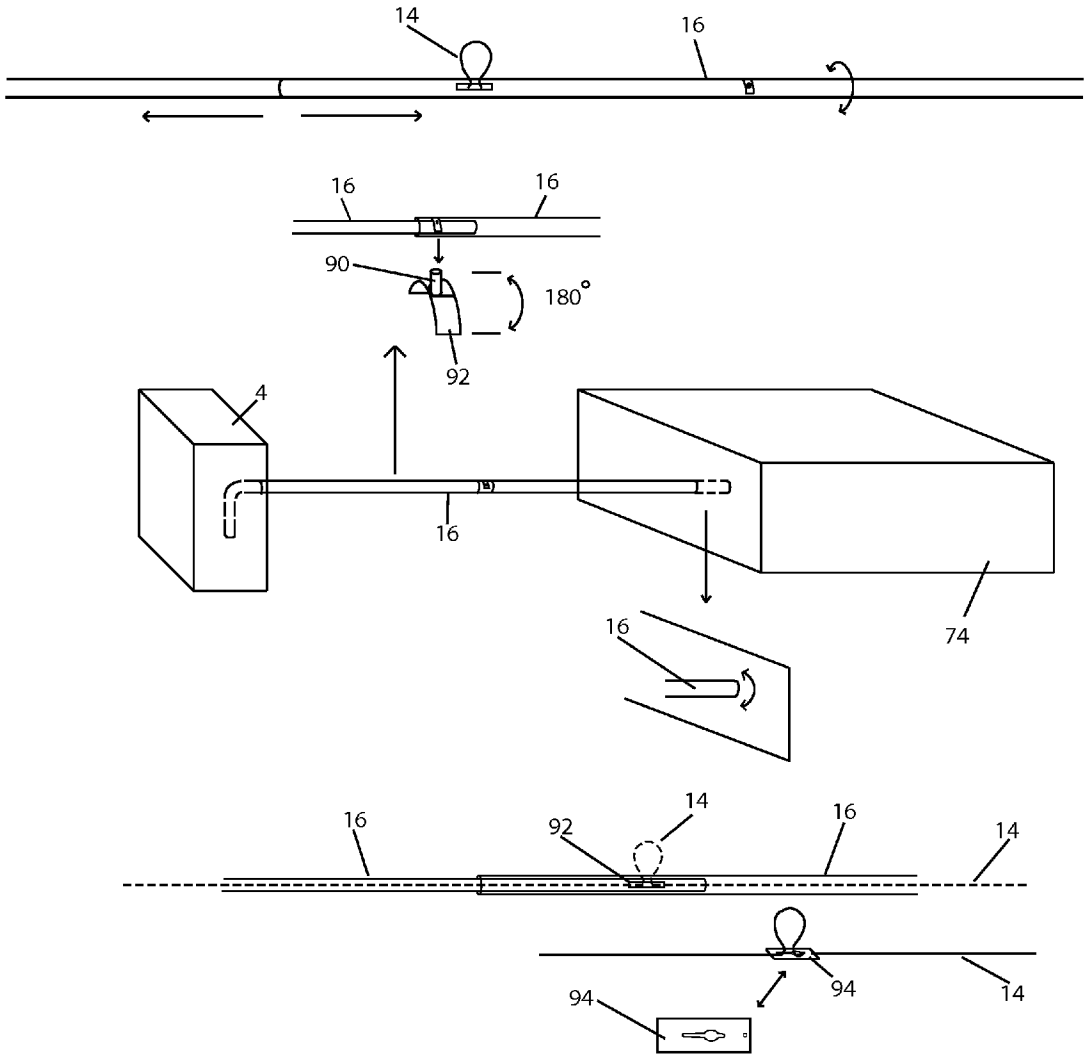

Referring to FIG. 8, a transmission swivel and length adjustment mechanisms comprising; an ornament upper housing 4, a transmission mechanism 14, a transmission conduit 16, a remote motor housing 74, a guide pin 90, a slot 92, a transmission length adjustment connector 94. This can be used in any of the embodiments so that the distance and angle between the upper motor housing 4, and the remote motor housing 74, can be adjustable. To adjust the length in this embodiment one would change the size of loop of the transmission mechanism 14. The transmission length adjustment connector 94, would pinch one side of the loop in the transmission 14, and hold it in place where the user positions it. In this embodiment the swivel adjustment of the transmission conduit 16, can have a pin 90, in the smaller transmission conduit 16, that rides in a slot 92. The slot 92, can have between a 90 and an 180 degree path for the pin 92, to ride in.

Figure 9:
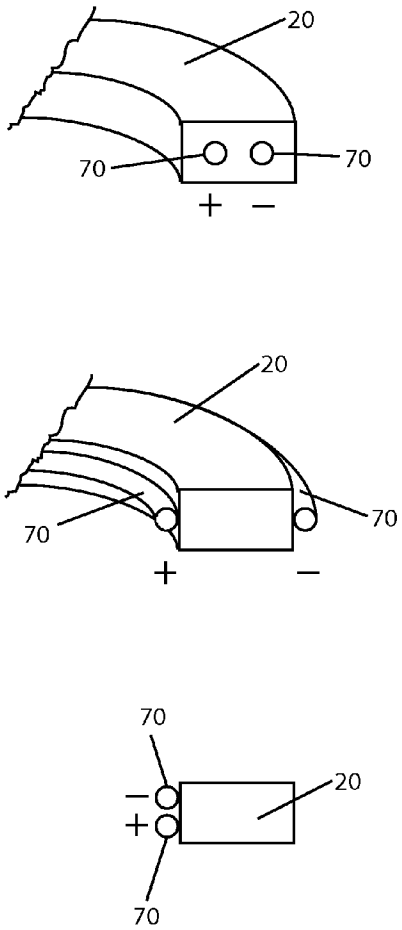

Referring to FIG. 9, a spring power extension comprising; spring 20, wire 70. In this embodiment the spring can be the conduit for the electrical wire that supplies power to the ornament 2. The wire can be embedded in the spring or be attached to the outside of the spring.

Figure 11:
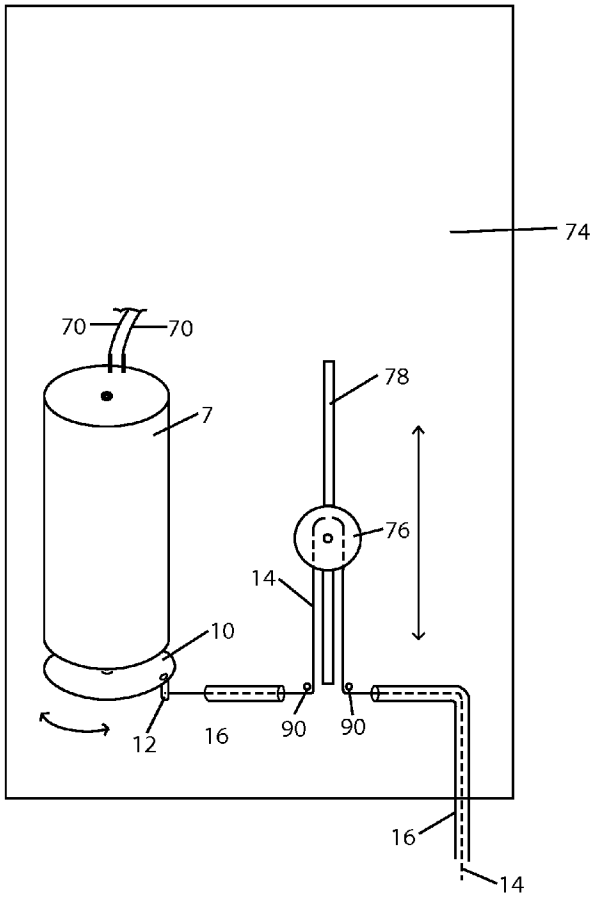

Referring to FIG. 11, an alternate transmission length adjustment mechanism comprising; motor 7, rotor 10, a transmission attachment swivel mechanism 12, a transmission 14, a transmission conduit 16, wire 70, a remote motor housing 74, a pulley 76, a pulley track 78, a guide pin 90. In this embodiment the transmission mechanism 14, rides over a pulley 76 that can be adjusted by moving it in either direction on the pulley track 78. In order for the transmission mechanism 14, to maintain its original path it can ride over pins 90 on either side of the pulley path.

What is claimed is:

1. A bouncing ornament comprising:

a rotor comprising a front surface and an outer edge forming the circumference of the rotor;

a motor operable to rotate the rotor;

a housing;

a tether running through the housing, wherein the tether comprises a first end and a second end;

a swivel connecting the first end of the tether to the front surface of the rotor, wherein the swivel is connected to the rotor off center of the front surface in between a longitudinal axis of the rotor and the outer edge of the rotor; and an ornament attached to the second end of the tether and disposed below the housing, wherein a same directional circular motion of the rotor pulls the ornament upward and releases the ornament downward.

2. The bouncing ornament of claim 1, further comprising a spring connecting the ornament to the second end of the tether.

3. The bouncing ornament of claim 1, further comprising a remote housing and a conduit, wherein the motor and the rotor are disposed within the remote housing and the tether runs from the housing to the remote housing through the conduit.

4. The bouncing ornament of claim 1, further comprising a sound device operable to play music.

5. The bouncing ornament of claim 1, further comprising lights secured to at least one of the ornament and the housing.

6. The bouncing ornament of claim 1, further comprising a motion sensor secured to the housing.

7. The bouncing ornament of claim 1, further comprising a photovoltaic sensor secured to the housing.

8. The bouncing ornament of claim 1, further comprising a timer operable to turn the motor on and off once a pre set time has been reached.

* * * * *